United States Patent [19]

Boyn

[11] Patent Number: 4,967,451

[45] Date of Patent: Nov. 6, 1990

[54] FIXING STRUCTURE OF A SHOPPING BAG HANDLE

[76] Inventor: Hong S. Boyn, 571-28 Kongneung-1 Dong, Nowon-Ku, Seoul, Rep. of Korea

[21] Appl. No.: 367,739

[22] Filed: Jun. 19, 1989

[30] Foreign Application Priority Data

Jun. 23, 1988 [KR] Rep. of Korea ..... 1988-9719

[51] Int. Cl.[5] ..... B65D 77/10

[52] U.S. Cl. ..... 24/30.5 R; 383/11; 383/25

[58] Field of Search ..... 383/11, 25, 26; 24/30.5 R, 115 A, 265 A, 114.5

[56] References Cited

U.S. PATENT DOCUMENTS

| | | | |
|---|---|---|---|
| 1,564,101 | 12/1925 | Nakamura | 383/25 X |
| 3,323,184 | 6/1967 | Reiter | 24/114.5 |
| 3,727,829 | 4/1973 | Huni | 24/30.5 R X |

FOREIGN PATENT DOCUMENTS

| | | |
|---|---|---|
| 5743386 | 10/1977 | Japan . |
| 53-7923 | 2/1978 | Japan . |
| 52-4330 | 1/1979 | Japan . |
| 57-9232 | 2/1982 | Japan . |
| 59-33789 | 9/1984 | Japan . |

*Primary Examiner*—James R. Brittain

*Attorney, Agent, or Firm*—Laurence R. Brown

[57] ABSTRACT

A fixing structure of a shopping bag handle comprises a fixture for stiffly fastening both ends of a handle portion such as a string and a flange perforated at the center integrally to each other, in which the fixture has tooth portions formed at sides of its ends to prevent the handle portion from sliding out, and the flange has a plurality of pointed projectors extended from the circumference of the center hole through the bag wall for attaching the handle portion to the shopping bag, and has affixed to the flange a snap button or magic tape, as locking means for closing the opening of the shopping bag.

5 Claims, 4 Drawing Sheets

FIXING STRUCTURE OF A SHOPPING BAG HANDLE

BACKGROUND OF THE INVENTION

The present invention is related to providing a fastening or fixing structure for a shopping bag handle, to which the string or braided cord is connected.

Conventionally, numerous methods have been used for fixing the handle portion to the shopping bag, for example, making a knot at both ends of the string which is formed as the handle portion, using an adhesive agent, or other method for moulding the fixing element at one side of the bag handle and other fixing element at one portion of the bag assembled to said element in a way that the synthetic resin or plastic material is ejected.

But, such methods have problems that the handle portion for tying a knot at both ends of the string has been often unknotted by itself to be removed out of the hole of the knot carrying the bag, and in order to use the adhesive agent the handle portion including the string or any other member as well as the attached members such as the thickness board paper or the film, etc. are required and its manufacture is complex. Also, the moulding method of the synthetic resins causes the manufacturing cost to be increased comparing with the above methods due to performing the ejection mould of each of the handle portion and its fixing portion. Further, all of these methods do not suggest the means for closing the opening portion of the shopping bag, and therefore it is inconvenient to use the shopping bag for carrying articles not intended to be exposed to the third party.

Considering these problems, the object of the present invention is to provide the fixing structure for attaching the handle portion to the shopping bag.

The other object of the present invention is to provide the fixing structure including locking means for closing the opening portion of the shopping bag, which can be selectively used if necessary.

SUMMARY OF THE INVENTION

Thus, the present invention is provided with a fixture for stiffly fastening both ends of a handle portion such as a string and a flange perforated at the center which are integrally formed to each other, in which a fixture has tooth portions formed at both sides of the handle ends to prevent the handle from sliding out of the hndle portion when its ends are opposed to each other, and a flange has a plurality of pointed projectors extended from the circumference of its center hole by using the bending method. Also, the present invention is provided with a locking means such as a snap button or a magic tape (Velcro) mounted on a plurality of pointed projectors to close the opening of the shopping bag having the articles inserted therein and prevent from exposing the articles to the outside.

As a result, the present invention has numerous advantages that the aspect of the handle portion is aesthetic, the condition for fixing the handle portion to the shopping bag is relatively stronger, and also it prevents the exposure of the contents inserted into the shopping bag, which is not intended to be announced to the third party.

BRIEF DESCRIPTION OF THE DRAWINGS

The above and other objects of the present invention will be seen by reference to the description taken in connection with the accompanying drawings, in which.

FIG. *7a* is showing the locking means using the snap button,

FIG. *7b* is showing the locking means using the magic tape, and

FIG. *7c* is showing the locking means using the modified snap button.

DETAIL DESCRIPTION OF THE INVENTION

Figure 1:
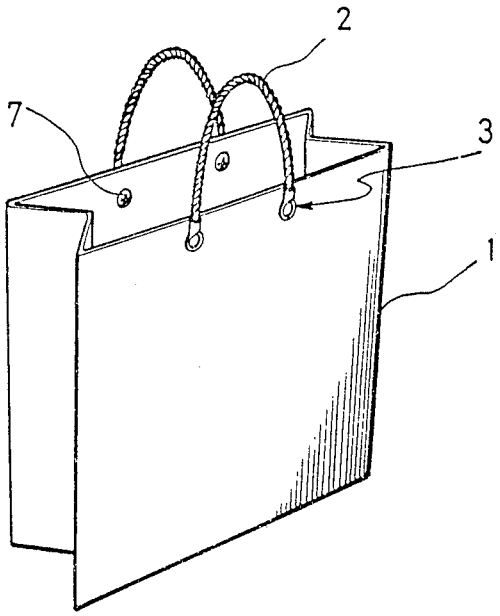
FIG. 1 is a perspective view showing the use of the present invention.
Figure 2:
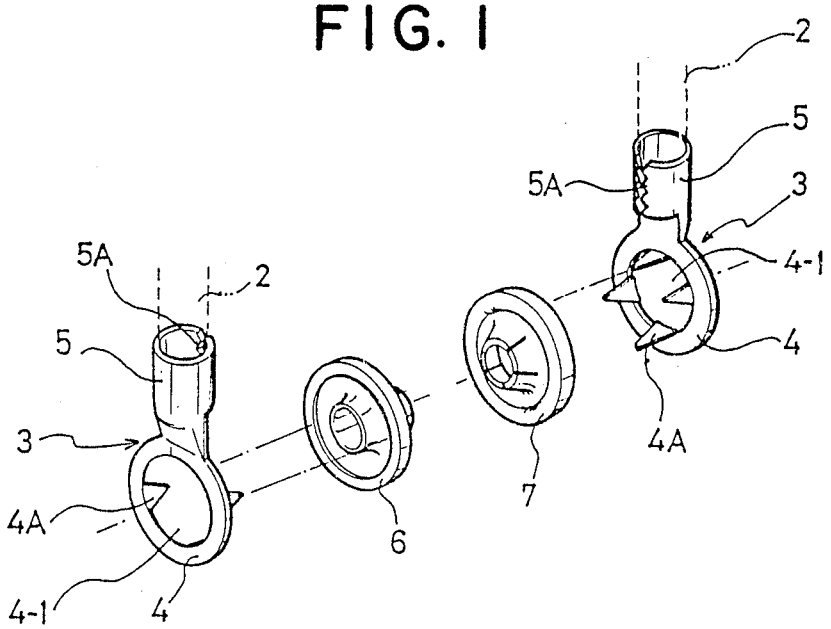
FIG. 2 is a exploded perspective view showing the fixing structure provided with the locking means.
Figure 3:
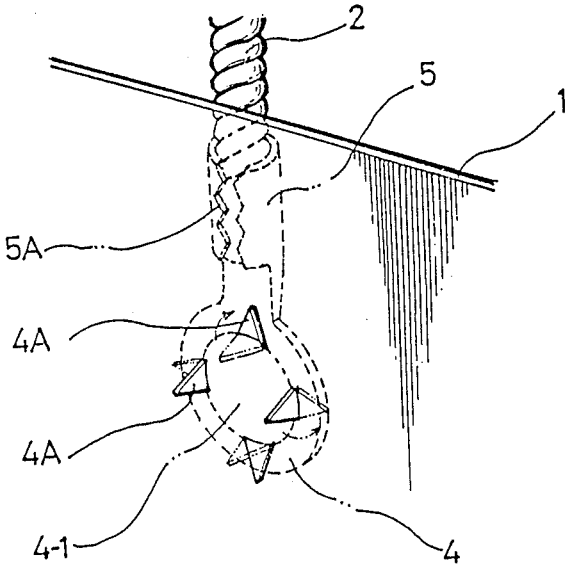
FIG. 3 is a partly enlarged view showing the fixture attached to one end of the handle portion.
Figure 4:
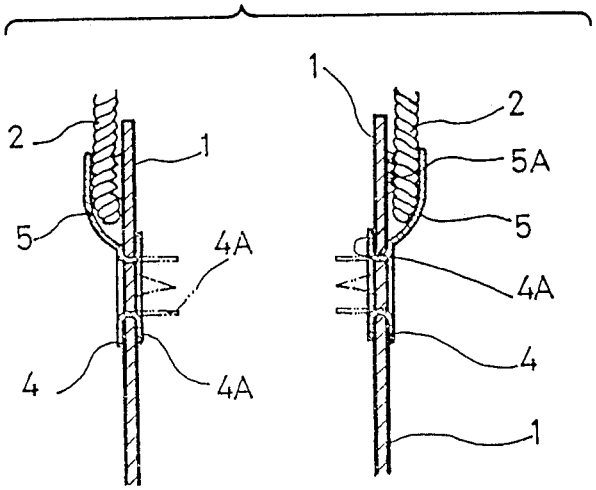
FIG. 4 is a longitudinally crossectional view of FIG. 3.

Referring to the drawings, shopping bag 1 is made of paper or vinyl and provided with handle portion 2 for carrying it. In order to attach handle portion 2 to shopping bag 1, fixing structure 3 comprises fixture 5 having tooth portions 5A formed at both sides of its end for being clamped onto both ends of handle portion 2 and flange 4 having center hole 4-1 perforated at its center and a plurality of pointed projectors 4A extended inward from the circumference of center hole 4-1. These pointed projectors 4A are inserted at the predetermined place from the outer into the inner fixture near the upper portion of the shopping bag 1 and bent inward to serve to prevent from removing from fixture 6 by forces of snap buttons 7 and 8, respectively, to be fitted thereon to use as the locking means for closing the opening of the bag as shown in FIGS. 2, 3, and 4 or FIG. *7a* and FIG. *7c*.

Figure 5:
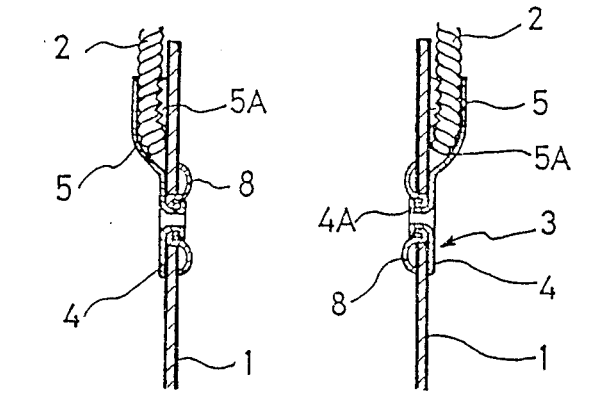
FIG. 5 is a longitudinally crossectional view showing the handle fixing structure with the washer.

The other embodiment of the present invention uses the washer. Washer 9 is fitted onto pointed projector 4A which is pierced and positioned into the inner side of the bag. And then the end of pointed projector 4A is outwardly bended onto washer 8 to be clamped down as shown in FIG. 5 or retains magic tape 9 which may be used as the locking means of handle portion 2 as shown in FIG. *7b*.

Figure 6:
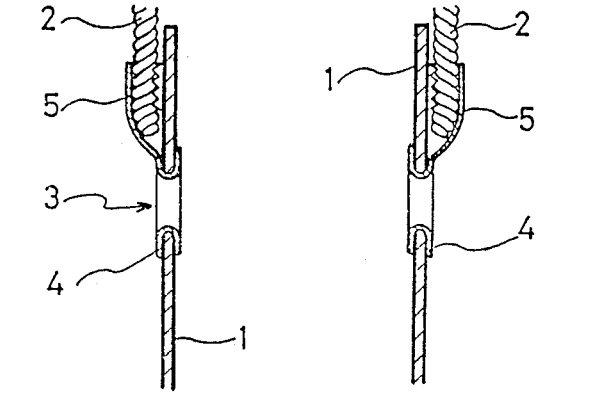
FIG. 6 is a longitudinally crossectional view showing the handle fixing structure which may be riveted.
Figure 7A:
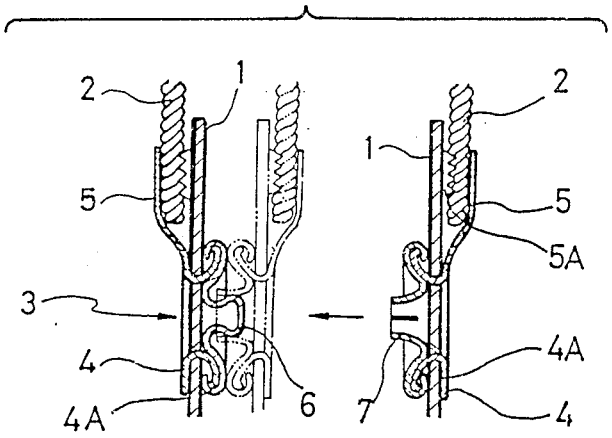
FIG. 7 are crosssectional views showing the handle fixing structure provided with the locking means.
Figure 7B:
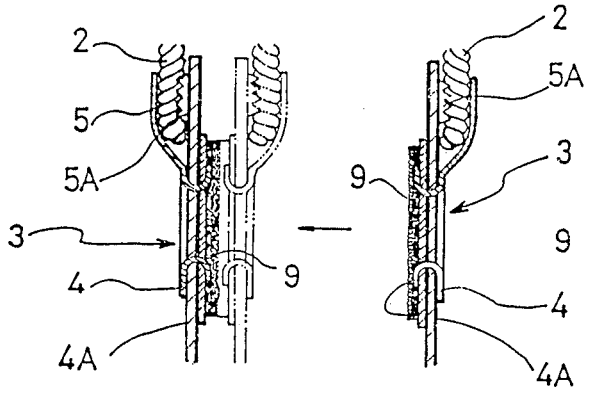
Figure 7C:
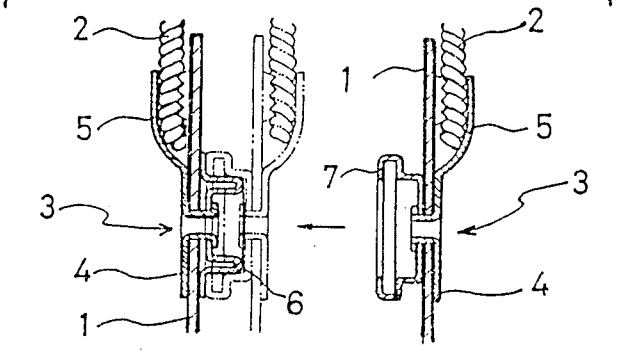

Also, another embodiment of the present invention uses the riveting member. Riveting member 10 of the tube type is mounted into the hole of fixture 3 by the riveting as shown in FIG. 6.

As described above, the present invention concerns fixing structure 3 used in attaching handle portion 2 to shopping bag 1. Fixing structure 3 includes flange 4 coupled to shopping bag 1 and fixture 5 coupled with handle portion 2. Fixture 5 is provided with tooth portion 5A formed at both sides of its ends. Thus, when fixture 5 is folded to form the hole for inserting the end of handle portion 3 such like the string and pressed by means of the pressing tools, tooth portion 5A fastens down the end of handle portion 2 to prevent the removal of handle portion 2 from fixture 5, if the end of handle portion 2 is not forcibly pulled out of the string inserting hole.

Flange 4 is provided with hole 4-1 perforated at the center and pointed projector 4A pierced from the outer bag surface into the inner surface near the upper portion of shopping bag 1 with the hole being not formed in the shopping bag. Therefore, pointed perforator 4A is bent and serves to connect fixture 5 to shopping bag 1.

On the other hand, pointed projector 4A retains magic tape 9 without being bent and then is to support magic tape 9. Also, it allows male and female snap buttons 6 and 7 to be inserted thereonto and then is bent to fix them to the flange. Also, the present invention serves to fix the handle portion to the shopping bag as well as to close the opening of the shopping bag.

Further, the present invention can use the washer and the riveting member thereby to enhance the safety and realize the good connection according to coupling the handle portion to the shopping bag without a plurality of pointed projectors being formed.

Thus, the fixing structure of the shopping bag in accordance with the present invention is very practical and useful with a result that the closing connection of the handle portion and the shopping bag is safe and stiff to have the reliability.

What is claimed is:

1. A fixing structure for attaching a handle portion to a shopping bag with an opening comprising in combination;

a fixture for stiffly fastening to both ends of a handle portion, a flange perforated at the center integrally connected to the fixture, said fixture having tooth portions to prevent said handle portion from sliding out, and a flange having a plurality of pointed projectors extended from a circumference of a center hole therein, and locking means for closing the opening of said bag mounted on said flange.

2. A fixing structure for attaching a handle portion to a shopping bag as claimed in claim 1, wherein;

said fixture is crimped onto the end of said handle portion and said pointed projectors pierce an outer surface into an inner surface adjacent to an upper end of said bag and are bent to fix the flange to the bag.

3. A fixing structure for attaching a handle portion to a shopping bag as claimed in claim 1, wherein;

a rivet is mounted into the center hole of said flange and rivetted thereon.

4. A fixing structure for attaching a handle portion to a shopping bag as claimed in claim 1, wherein;

male and female snap buttons are inserted into said pointed projectors and mounted on said flanges by means of said pointed projectors, thereby for closing and opening the opening of said bag.

5. A fixing structure for attaching a handle portion to a shopping bag as claimed in claim 1, wherein;

The locking means is tape.

* * * * *